US009849683B2

(12) United States Patent
Nishimura

(10) Patent No.: US 9,849,683 B2
(45) Date of Patent: Dec. 26, 2017

(54) INK PORT ADAPTER FOR INKJET HEAD

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/489,633

(22) Filed: Apr. 17, 2017

(65) Prior Publication Data

US 2017/0253048 A1 Sep. 7, 2017

Related U.S. Application Data

(63) Continuation-in-part of application No. 15/058,093, filed on Mar. 1, 2016, now Pat. No. 9,669,633.

(51) Int. Cl.
*B41J 2/175* (2006.01)

(52) U.S. Cl.
CPC ..... *B41J 2/17523* (2013.01)

(58) Field of Classification Search
CPC ..... B41J 2/17523
USPC ..... 347/85
See application file for complete search history.

(56) References Cited

U.S. PATENT DOCUMENTS

2002/0101487 A1* 8/2002 Petersen ..... B41J 2/17509 347/85
2004/0085394 A1* 5/2004 Martin ..... B41J 2/14072 347/42
2013/0321535 A1* 12/2013 Mauck ..... B41J 2/17596 347/85

* cited by examiner

*Primary Examiner* — Huan Tran
*Assistant Examiner* — Alexander D Shenderov
(74) *Attorney, Agent, or Firm* — Duft Bornsen & Fettig LLP

(57) ABSTRACT

Ink port adapters for inkjet heads. In one embodiment, the ink port adapter includes two hose fittings for connecting to hoses, and four openings that align with four ink ports of an inkjet head. The adapter includes one ink path that connects one of the hose fittings to two of the openings, and another ink path that connects the other hose fitting to the other two openings.

20 Claims, 17 Drawing Sheets

INK PORT ADAPTER FOR INKJET HEAD

RELATED APPLICATIONS

This non-provisional patent application is a continuation-in-part of U.S. patent application Ser. No. 15/058,093 filed on Mar. 1, 2016, which is incorporated herein by reference.

FIELD OF THE INVENTION

The following disclosure relates to the field of printing, and in particular, to inkjet heads used in printing.

BACKGROUND

Inkjet printing is a type of printing that propels drops of ink (also referred to as droplets) onto a medium, such as paper, a substrate for 3D printing, etc. The core of an inkjet printer includes one or more print heads (referred to herein as inkjet heads) having multiple ink channels arranged in parallel to discharge droplets of ink. A typical ink channel includes a nozzle, a chamber, and a mechanism for ejecting the ink from the chamber and through the nozzle, which is typically a piezoelectric actuator connected to a diaphragm. To discharge a droplet from an ink channel, a drive circuit provides a drive waveform to the piezoelectric actuator of that ink channel that includes a jetting pulse. In response to the jetting pulse, the piezoelectric actuator generates pressure oscillations inside of the ink channel to push the droplet out of the nozzle. The drive waveforms provided to individual piezoelectric actuators control how droplets are ejected from each of the ink channels.

Inkjet heads are typically configured as single-color, two-color, or four-color heads. Users select the type of inkjet head based on their printing needs. For example, if a user has a need for both two-color and four-color printing, then they will select both a two-color and a four-color inkjet head. Users may therefore need to purchase multiple types of inkjet heads based their printing needs.

SUMMARY

Embodiments described herein include adapters for inkjet heads. The adapters as described herein may reduce the number of colors that are printed with an inkjet head. For example, an adapter may allow a two-color inkjet head to print in single-color. The adapters may reduce the number of connecting hoses that are needed to connect an inkjet head to an ink reservoir or return reservoir. Therefore, use of adapters as described herein advantageously gives users flexibility in how inkjet heads are used for printing.

One embodiment is an ink port adapter for an inkjet head. The ink port adapter comprises a body having a first surface and a second surface, a supply hose fitting that extends from the first surface of the body, a return hose fitting that extends from the first surface of the body, two supply openings on the second surface of the body, two return openings on the second surface of the body, a first ink path through the body that connects the supply hose fitting to the supply openings, a second ink path through the body that connects the return hose fitting to the return openings, and a bypass path that connects between the first ink path and the second ink path.

In another embodiment, the inkjet head includes a plurality of flow-through ink channels, and the bypass path has a higher fluid resistance than the flow-through ink channels of the inkjet head.

In another embodiment, the ink port adapter further includes a cap configured to cover the supply hose fitting or the return hose fitting.

In another embodiment, fastening members are configured to attach the ink port adapter to the inkjet head.

In another embodiment, the ink port adapter further includes a plurality of connecting holes through the body to align with threaded holes on one end of the inkjet head, and the fastening members are inserted through the connecting holes of the ink port adapter to screw into the threaded holes on the one end of the inkjet head.

In another embodiment, the supply hose fitting connects with a supply reservoir for a single color of ink via a first hose, and the return hose fitting connects with a return reservoir for the single color of ink via a second hose.

Another embodiment comprises an apparatus comprising an inkjet head having flow-through ink channels, where each end of the inkjet head includes two inlet ink ports and two outlet ink ports. The apparatus further includes a first ink port adapter and a second ink port adapter. Each of the first ink port adapter and the second ink port adapter comprises a body having a first surface and a second surface, a supply hose fitting that extends from the first surface of the body, a return hose fitting that extends from the first surface of the body, two supply openings on the second surface of the body that align with the two inlet ink ports on one end of the inkjet head, two return openings on the second surface of the body that align with the two outlet ink ports on the one end of the inkjet head, a first ink path through the body that connects the supply hose fitting to the supply openings, a second ink path through the body that connects the return hose fitting to the return openings, and a bypass path that connects between the first ink path and the second ink path. The first ink port adapter is attached to a first end of the inkjet head, and the second ink port adapter is attached to a second end of the inkjet head.

In another embodiment, a first cap is attached to the return hose fitting on the first ink port adapter, and a second cap is attached to the supply hose fitting on the second ink port adapter.

In another embodiment, a first hose is attached to the supply hose fitting on the first ink port adapter, and is attached to a supply reservoir for a single color of ink. A second hose is attached to the return hose fitting on the second ink port adapter, and is attached to a return reservoir for the single color of ink.

In another embodiment, a pressure differential is created between the supply reservoir and the return reservoir.

In another embodiment, the bypass path has a higher fluid resistance than the flow-through ink channels of the inkjet head.

In another embodiment, the apparatus further includes o-rings compressed between the supply openings and the return openings of the first ink port adapter, and the inlet ink ports and the outlet ink ports on the first end of the two-color inkjet head. The o-rings are seated in recesses in the inlet ink ports and the outlet ink ports on the first end of the inkjet head.

Another embodiment comprises an inkjet head having flow-through ink channels, where each end of the inkjet head includes two inlet ink ports and two outlet ink ports. The apparatus further includes a first ink port adapter and a second ink port adapter. Each of the first ink port adapter and the second ink port adapter comprises a body having a first surface and a second surface, a supply hose fitting that extends from the first surface of the body, a return hose fitting that extends from the first surface of the body, two supply openings on the second surface of the body that align with the two inlet ink ports on one end of the inkjet head, two return openings on the second surface of the body that align with the two outlet ink ports on the one end of the inkjet head, a first ink path through the body that connects the supply hose fitting to the supply openings, and a second ink path through the body that connects the return hose fitting to the return openings. The first ink port adapter is attached to a first end of the inkjet head, and the second ink port adapter is attached to a second end of the inkjet head.

In another embodiment, a first cap is attached to the return hose fitting on the first ink port adapter, and a second cap is attached to the supply hose fitting on the second ink port adapter.

In another embodiment, a first hose is attached to the supply hose fitting on the first ink port adapter, and is attached to a supply reservoir for a single color of ink. A second hose is attached to the return hose fitting on the second ink port adapter, and is attached to a return reservoir for the single color of ink.

In another embodiment, a first cap is attached to the return hose fitting on the second ink port adapter, and a second cap is attached to the supply hose fitting on the second ink port adapter.

In another embodiment, a first hose is attached to the supply hose fitting on the first ink port adapter, and is attached to a supply reservoir for a single color of ink. A second hose is attached to the return hose fitting on the first ink port adapter, and is attached to a return reservoir for the single color of ink.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
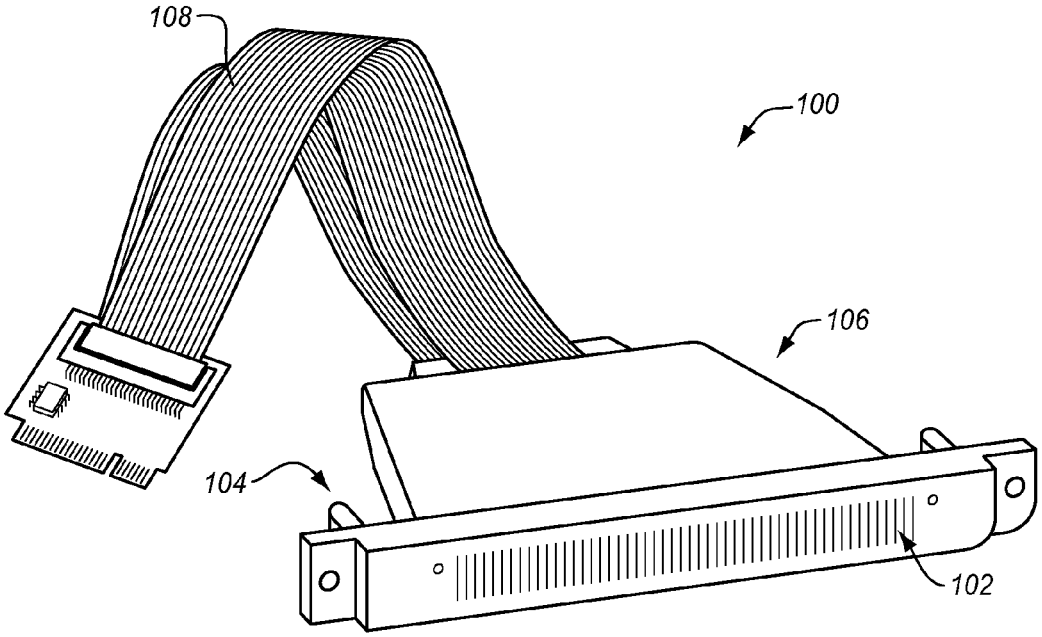
FIG. 1 illustrates an inkjet head.

FIG. 1 illustrates an inkjet head 100. Although not visible in FIG. 1, inkjet head 100 includes a nozzle surface 102 with one or more rows of nozzles that jet or eject droplets of liquid material, such as ink (e.g., water, solvent, oil, or UV-curable). Opposite the nozzle surface 102 is the side of inkjet head 100 used for input/output (I/O) of ink, electronic signals, etc. This side of inkjet head 100 is referred to as the I/O side 104. I/O side 104 includes electronics 106 that connect to a data source through cabling 108. Electronics 106 control how the nozzles of inkjet head 100 jet droplets of ink. As will be described in more detail below, I/O side 104 also includes ink ports for transferring ink into or out of inkjet head 100. Although the term "ink" is used herein, inkjet head 100 is capable of dispersing different types of liquid material used for printing.

Figure 2:
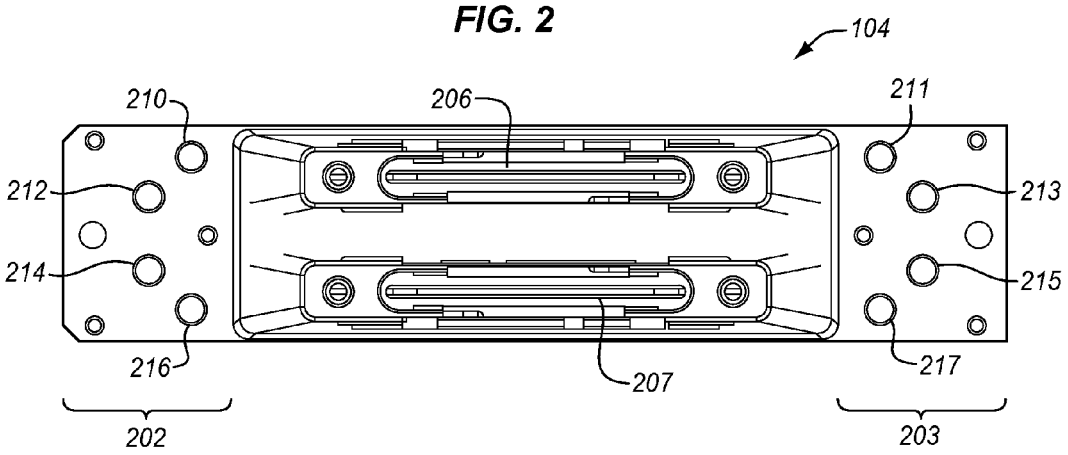
FIG. 2 illustrates an I/O side of an inkjet head in one example.
Figure 3:
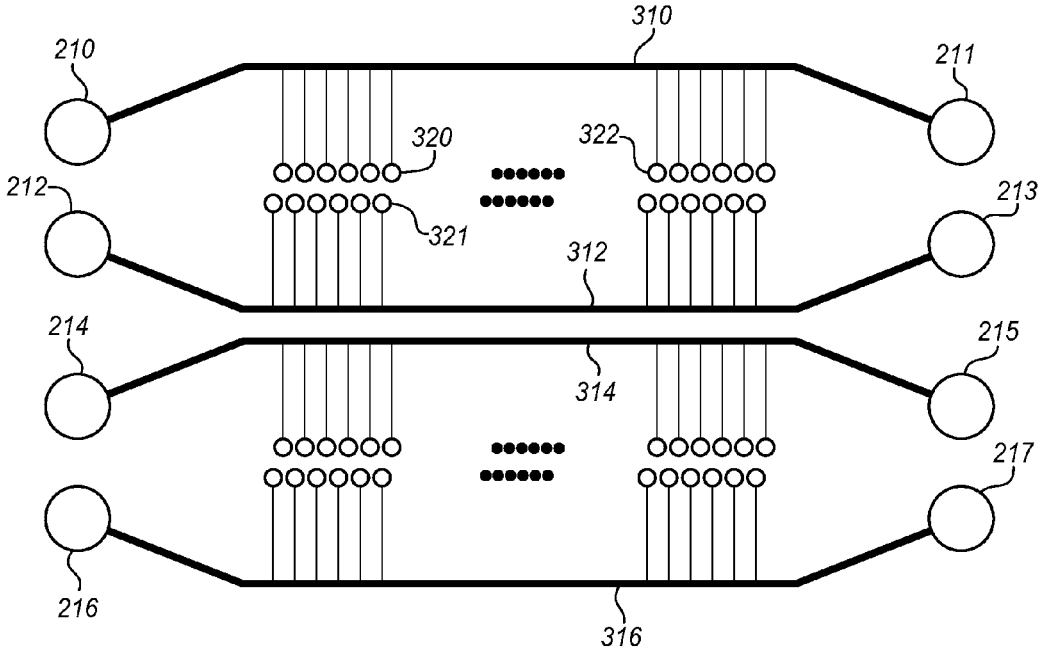
FIG. 3 is a schematic view of an inkjet head.

FIG. 2 illustrates the I/O side 104 of inkjet head 100 in one example. In the example shown in FIG. 2, inkjet head 100 may comprise a four-color head. I/O side 104 has two ends 202-203 that are separated by electrical connectors 206-207. Each end 202-203 includes four ink ports. For example, end 202 includes ink ports 210, 212, 214, and 216. End 203 includes ink ports 211, 213, 215, and 217. An ink port represents an opening for receiving ink from an ink supply, or transferring ink out of inkjet head 100. Ink ports 210-217 provide a pathway to ink manifolds within inkjet head 100. An ink manifold is a conduit within an inkjet head for providing ink to a plurality of ink channels/nozzles for jetting. FIG. 3 is a schematic view of inkjet head 100 as shown in FIG. 2. Ink ports 210-211 provide pathways to an ink manifold 310, such as for a first color. Ink ports 212-213 provide pathways to an ink manifold 312, such as for a second color. Ink ports 214-215 provide pathways to an ink manifold 314, such as for a third color. Ink ports 216-217 provide pathways to an ink manifold 316, such as for a fourth color. Each of the ink manifolds 310-316 connects to a row of nozzles 320-322, and provides ink to the nozzles 320-322 for jetting.

Figure 4:
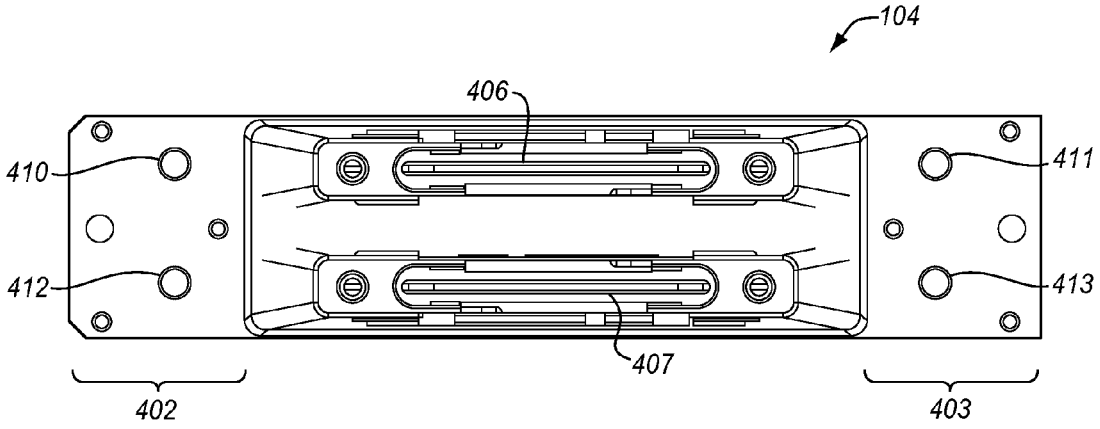
FIG. 4 illustrates an I/O side of an inkjet head in another example.
Figure 5:
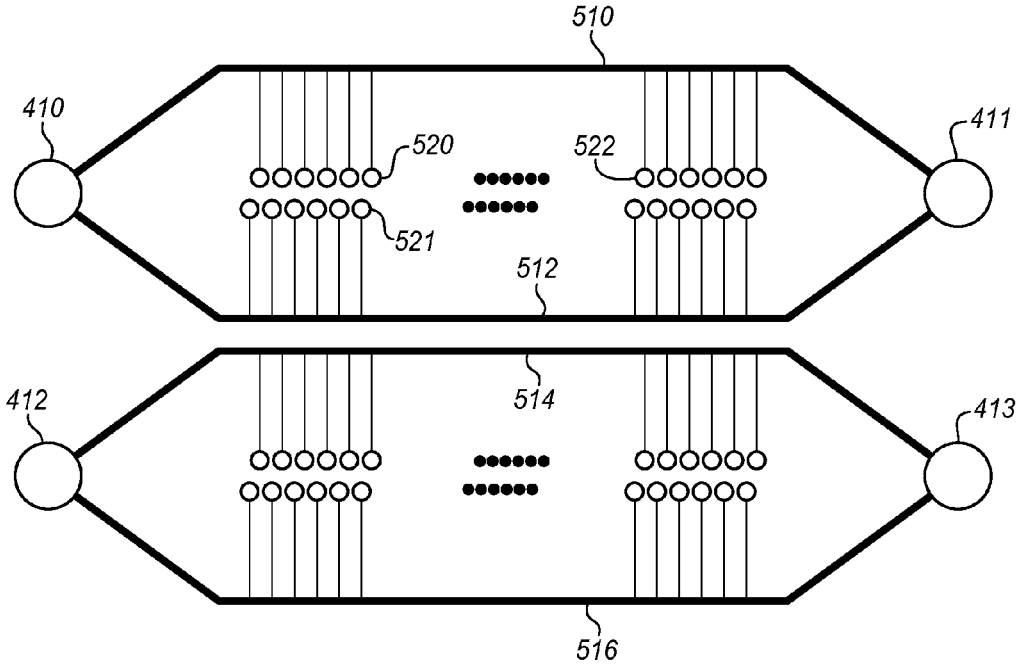
FIG. 5 is a schematic view of an inkjet head.

FIG. 4 illustrates the I/O side 104 of inkjet head 100 in another example. In the example shown in FIG. 4, inkjet head 100 may comprise a two-color head. I/O side 104 has two ends 402-403 that are separated by electrical connectors 406-407. Each end 402-403 includes two ink ports. For example, end 402 includes ink ports 410 and 412. End 403 includes ink ports 411 and 413. FIG. 5 is a schematic view of inkjet head 100 as shown in FIG. 4. Ink ports 410-411 provide pathways to ink manifolds 510 and 512, such as for a first color. Ink ports 412-413 provide pathways to ink manifolds 514 and 516, such as for a second color. Each of the ink manifolds 510-516 connects to a row of nozzles 520-522, and provides ink to the nozzles 520-522 for jetting.

When using inkjet heads as described above, a user may want to reduce the number of colors that are used with an inkjet head. For example, if a user has a four-color inkjet head, he/she may want to operate the four-color inkjet head as a two-color or a single-color inkjet head. If a user has a two-color inkjet head, he/she may want to operate the two-color inkjet head as a single-color inkjet head. To accommodate this, ink port adapters are described herein that allow multi-color inkjet heads to be used with a reduced number of colors. For example, an ink port adapter may convert a four-color inkjet head for use as a two-color or a single-color inkjet head. An ink port adapter may convert a two-color inkjet head for use as a single-color inkjet head. Descriptions of the ink port adapters are described below.

Figure 6:
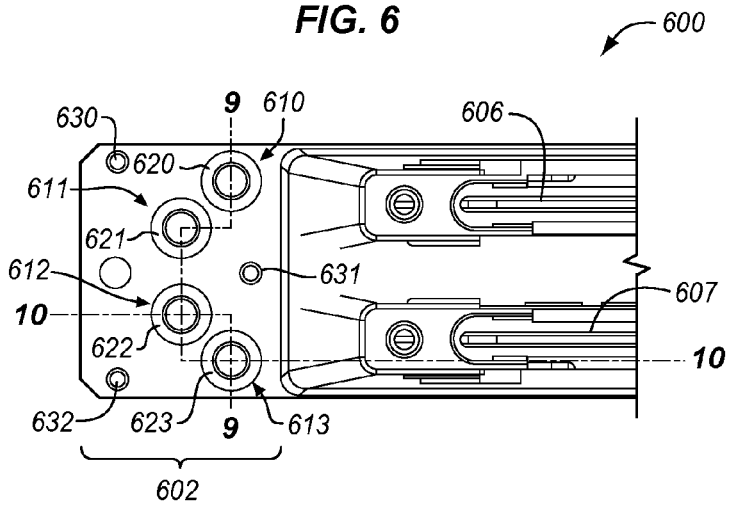
FIG. 6 illustrates one end of an inkjet head in an exemplary embodiment.

FIG. 6 illustrates one end of an inkjet head 600 in an exemplary embodiment. End 602 is separated from the other end (not shown) of inkjet head 600 by electrical connectors 606-607. End 602 includes four ink ports 610-613, which comprise openings for transferring ink to/from inkjet head 600. Although not visible in FIG. 6, each ink port 610-613 connects to an ink manifold within inkjet head 600. In this embodiment, ink ports 610-613 may each include a recess 620-623 for receiving an o-ring, which is described further below. End 602 also includes threaded holes 630-632 for receiving a fastening member, such as a screw or bolt.

Figure 7:
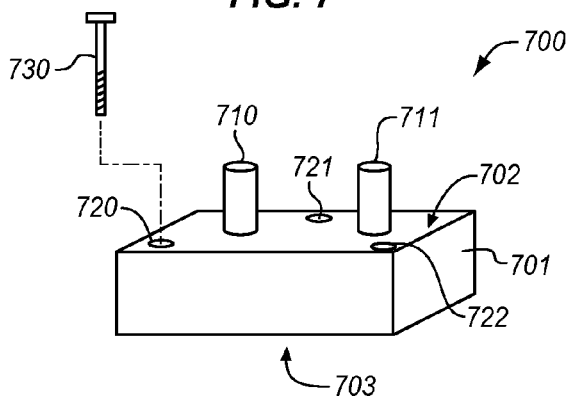
FIG. 7 is an isometric view of an ink port adapter in an exemplary embodiment.

If inkjet head 600 is a four-color inkjet head, it may be used as a two-color inkjet head with the use of ink port adapters as described herein. FIG. 7 is an isometric view of an ink port adapter 700 in an exemplary embodiment. Ink port adapter 700 is an apparatus that may convert a four-color inkjet head to a two-color inkjet head. Ink port adapter 700 includes a body 701 having a top surface 702 and a bottom surface 703. Although the terms "top" and "bottom" are used herein, it is merely to distinguish the surfaces 702-703 in FIG. 7. The body 701 of ink port adapter 700 may be made from plastic, Teflon®, or any other desired material. Top surface 702 includes hose fittings 710-711, which are hollow cylindrical features that extend from top surface 702 to act as a connection point for a hose, such as from an ink reservoir. A hose is able to slide over each of hose fittings 710-711. Although not shown in FIG. 7, hose fittings 710-711 may be barbed or have other surface features for securing a hose. Ink port adapter 700 also includes a plurality of connecting holes 720-722 that pass from top surface 702 to bottom surface 703 to align with threaded holes 630-632 on inkjet head 600. Fastening members 730, such as screws or bolts, are inserted through connecting holes 720-722, and screw into threaded holes 630-632 to secure ink port adapter 700 to inkjet head 600.

Figure 8A:
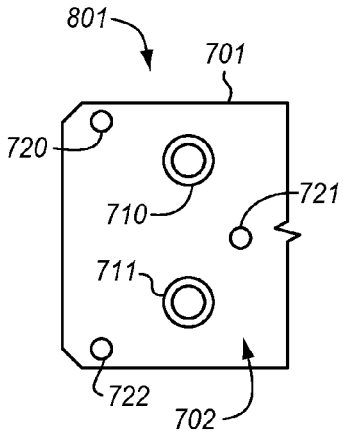
FIGS. 8A-8B illustrate top and bottom views of an ink port adapter in an exemplary embodiment.
Figure 8B:
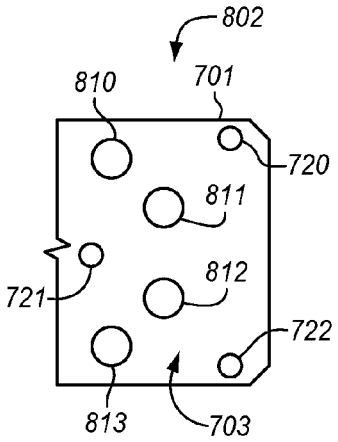

FIGS. 8A-8B illustrate top and bottom views of ink port adapter 700 in an exemplary embodiment. The top view 801 in FIG. 8A illustrates hose fittings 710-711 and connecting holes 720-722 on top surface 702 of ink port adapter 700. The bottom view 802 in FIG. 8B illustrates four openings 810-813 on bottom surface 703 of ink port adapter 700, and connecting holes 720-722. As is evident from top view 801 and bottom view 802, connecting holes 720-722 pass through the body 701 of ink port adapter 700 from top surface 702 to bottom surface 703. Openings 810-813 are configured to align with the four ink ports 610-613 of inkjet head 600 (see FIG. 6). Although not visible in FIGS. 8A-8B, an ink path passes through body 701 that connects hose fitting 710 to openings 810-811. Another separate ink path passes through body 701 that connects hose fitting 711 to openings 812-813. An ink path is a hollow channel through body 701 that allows ink to flow, such as between a hose fitting 710-711 on top surface 702 and multiple openings 810-813 on bottom surface 703.

Figure 9:
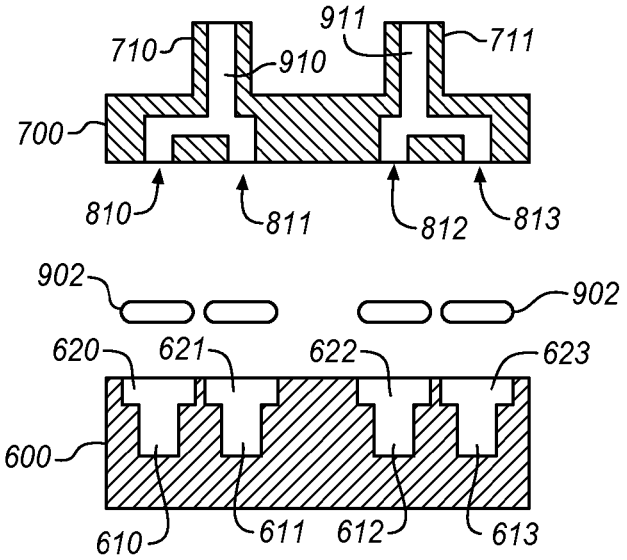
FIGS. 9-10 are cross-sectional views of an ink port adapter being attached to an inkjet head in an exemplary embodiment.
Figure 10:
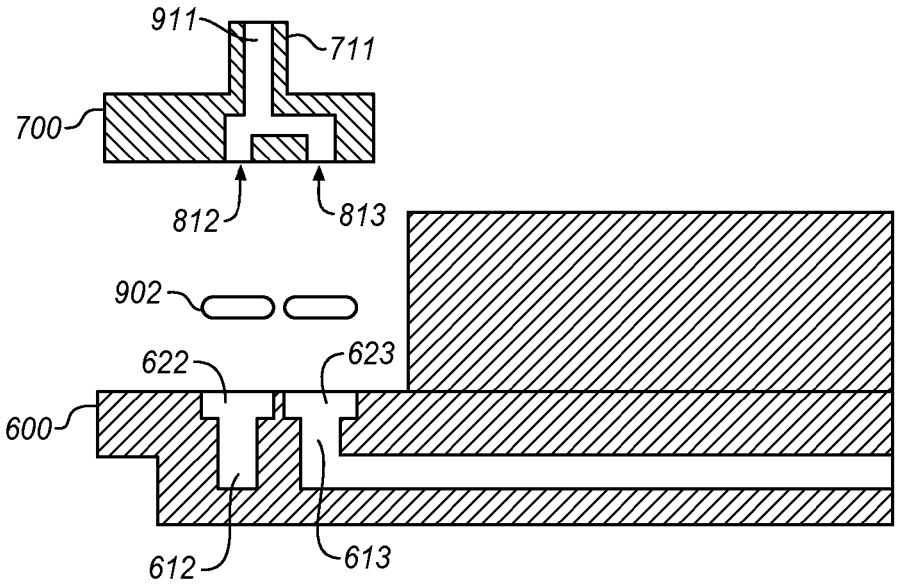

FIGS. 9-10 are cross-sectional views of ink port adapter 700 being attached to inkjet head 600 in an exemplary embodiment. FIG. 9 is a cross-section substantially along line 9-9 of FIG. 6, and FIG. 10 is a cross-section substantially along line 10-10 of FIG. 6. Ink ports 610-613 of inkjet head 600 include recesses 620-623, respectively. O-rings 902 may be inserted into recesses 620-623. When compressed, o-rings 902 provide a seal between ink port adapter 700 and inkjet head 600. Openings 810-813 on ink port adapter 700 align with ink ports 610-613 to provide a fluid connection. An ink path 910 connects hose fitting 710 to openings 810-811. Therefore, ink flowing from a hose into hose fitting 710 will travel through adapter 700 to both opening 810 and opening 811. Another ink path 911 connects hose fitting 711 to openings 812-813. Therefore, ink flowing from a hose into hose fitting 711 will travel through adapter 700 to both opening 812 and opening 813.

When in use, ink port adapter 700 is placed onto end 602 of inkjet head 600, and is fastened to inkjet head 600 with fastening members 730. In FIG. 6, the other end (not shown) of inkjet head 600 will have a similar configuration with ink ports, and an ink port adapter may be attached to the other end of inkjet head 600 in a similar manner. Hoses are connected to hose fittings 710-711. The hoses may be attached to ink reservoirs of different colors to supply two colors of ink to inkjet head 600. When one color of ink is supplied through the hose connected to hose fitting 710, the ink will flow through hose fitting 710, through ink path 910, and out openings 810-811 into ink ports 610-611 of inkjet head 600. When another color of ink is supplied through the hose connected to hose fitting 711, the ink will flow through hose fitting 711, through ink path 911, and out openings 812-813 into ink ports 612-613 of inkjet head 600. Thus, even though inkjet head 600 has four ink ports 610-613 on each end able to receive four colors of ink, ink port adapter 700 allows inkjet head 600 to operate while receiving only two colors of ink.

Although o-rings 902 are illustrated in FIGS. 9-10, other types of sealing mechanisms may be used between ink port adapter 700 and inkjet head 600. For example, a gasket may be used as a sealing mechanism in another embodiment. When a gasket is used, recesses 620-623 may not be needed in ink ports 610-613.

Figure 11:
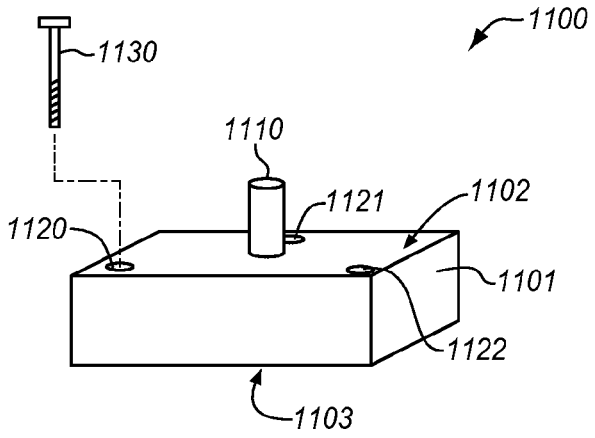
FIG. 11 is an isometric view of an ink port adapter in an exemplary embodiment.

If inkjet head 600 (see FIG. 6) is a four-color inkjet head, it may also be used as a single-color inkjet head with the use of other ink port adapters. FIG. 11 is an isometric view of an ink port adapter 1100 in an exemplary embodiment. Ink port adapter 1100 is an apparatus that may convert a four-color inkjet head to a single-color inkjet head. Ink port adapter 1100 includes a body 1101 having a top surface 1102 and a bottom surface 1103. Top surface 1102 includes a hose fitting 1110. Ink port adapter 1100 also includes a plurality of connecting holes 1120-1122 that pass from top surface 1102 to bottom surface 1103 to align with threaded holes 630-632 on inkjet head 600. Fastening members 1130 are inserted through connecting holes 1120-1122, and screw into threaded holes 630-632 to secure ink port adapter 1100 to inkjet head 600.

Figure 12A:
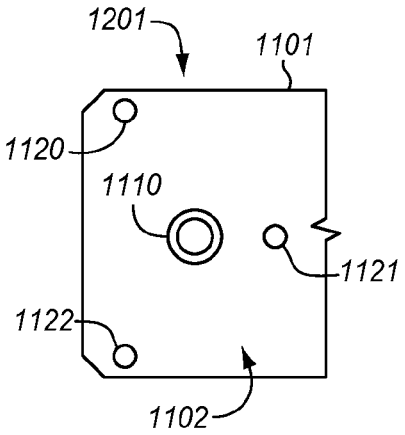
FIGS. 12A-12B illustrate top and bottom views of an ink port adapter in an exemplary embodiment.
Figure 12B:
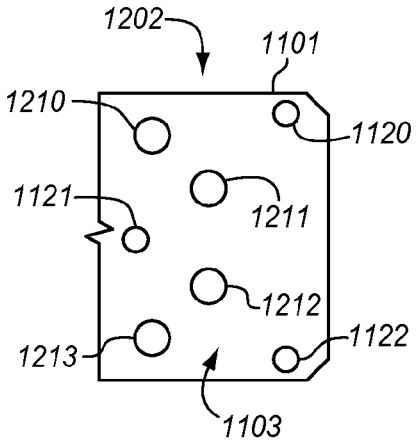

FIGS. 12A-12B illustrate top and bottom views of ink port adapter 1100 in an exemplary embodiment. The top view 1201 in FIG. 12A illustrates hose fitting 1110 and connecting holes 1120-1122 on top surface 1102 of ink port adapter 1100. The bottom view 1202 in FIG. 12B illustrates four openings 1210-1213 on bottom surface 1103 of ink port adapter 1100, and connecting holes 1120-1122. As is evident from top view 1201 and bottom view 1202, connecting holes 1120-1122 pass through the body 1101 of ink port adapter 1100 from top surface 1102 to bottom surface 1103. Openings 1210-1213 are configured to align with the four ink ports 610-613 of inkjet head 600 (see FIG. 6). Although not visible in FIGS. 12A-12B, an ink path passes through body 1101 that connects hose fitting 1110 to openings 1210-1213.

Figure 13:
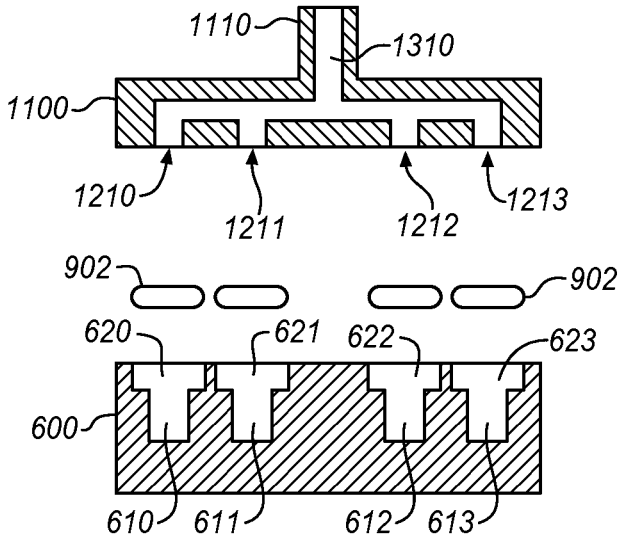
FIGS. 13-14 are cross-sectional views of an ink port adapter being attached to an inkjet head in an exemplary embodiment.
Figure 14:
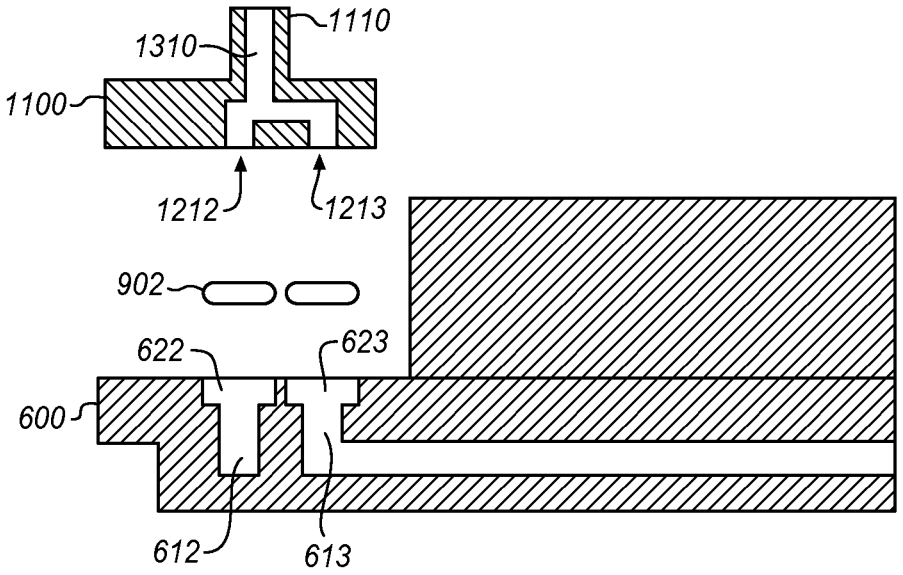

FIGS. 13-14 are cross-sectional views of ink port adapter 1100 being attached to inkjet head 600 in an exemplary embodiment. FIG. 13 is a cross-section substantially along line 9-9 of FIG. 6, and FIG. 14 is a cross-section along substantially line 10-10 of FIG. 6. Ink ports 610-613 of inkjet head 600 include recesses 620-623, respectively. O-rings 902 may be inserted into recesses 620-623. When compressed, o-rings 902 provide a seal between ink port adapter 1100 and inkjet head 600. Openings 1210-1213 on ink port adapter 1100 align with ink ports 610-613 to provide a fluid connection. An ink path 1310 connects hose fitting 1110 to openings 1210-1213. Therefore, ink flowing from a hose into hose fitting 1110 will travel through adapter 1100 to each of openings 1210-1213.

When in use, ink port adapter 1100 is placed onto end 602 of inkjet head 600, and is fastened to inkjet head 600 with fastening members 1130. In FIG. 6, the other end (not shown) of inkjet head 600 will have a similar configuration with ink ports, and an ink port adapter may be attached to the other end of inkjet head 600 in a similar manner. A hose is connected to hose fitting 1110. The hose may be attached to an ink reservoir of a single color to supply one color of ink to inkjet head 600. When one color of ink is supplied through the hose connected to hose fitting 1110, the ink will flow through hose fitting 1110, through ink path 1310, and out openings 1210-1213 into ink ports 610-613 of inkjet head 600. Thus, even though inkjet head 600 has four ink ports on each end for receiving four colors of ink, ink port adapter 1100 allows inkjet head 600 to operate while receiving only one color of ink.

Figure 15:
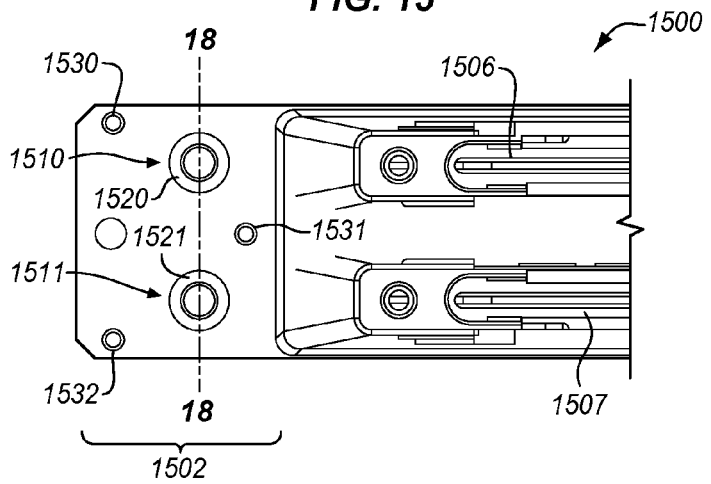
FIG. 15 illustrates one end of an inkjet head in an exemplary embodiment.

FIG. 15 illustrates one end of an inkjet head 1500 in an exemplary embodiment. End 1502 is separated from the other end (not shown) of inkjet head 1500 by electrical connectors 1506-1507. End 1502 includes two ink ports 1510-1511, which comprise openings for transferring ink to/from inkjet head 1500. Although not visible in FIG. 15, each ink port 1510-1511 connects to an ink manifold within inkjet head 1500. In this embodiment, ink ports 1510-1511 may each include a recess 1520-1521 for receiving an o-ring, which is described further below. End 1502 also includes threaded holes 1530-1532 for receiving a fastening member, such as a screw or bolt.

Figure 16:
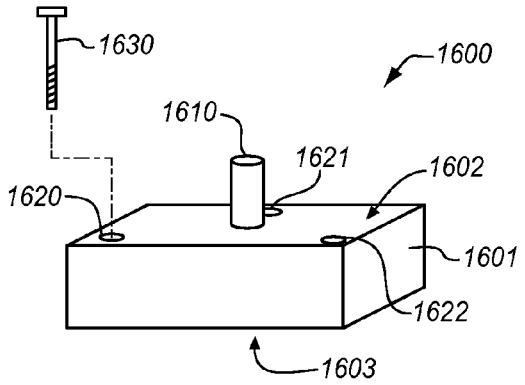
FIG. 16 is an isometric view of an ink port adapter in an exemplary embodiment.

If inkjet head 1500 is a two-color inkjet head, it may be used as a single-color inkjet head with the use of ink port adapters. FIG. 16 is an isometric view of an ink port adapter 1600 in an exemplary embodiment. Ink port adapter 1600 is an apparatus that may convert a two-color inkjet head to a single-color inkjet head. Ink port adapter 1600 includes a body 1601 having a top surface 1602 and a bottom surface 1603. Top surface 1602 includes a hose fitting 1610. Ink port adapter 1600 also includes a plurality of connecting holes 1620-1622 that pass from top surface 1602 to bottom surface 1603 to align with threaded holes 1530-1532 on inkjet head 1500. Fastening members 1630, such as screws or bolts, are inserted through connecting holes 1620-1622, and screw into threaded holes 1530-1532 to secure ink port adapter 1600 to inkjet head 1500.

Figure 17A:
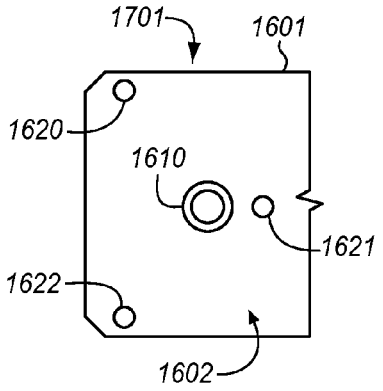
FIGS. 17A-17B illustrate top and bottom views of an ink port adapter in an exemplary embodiment.
Figure 17B:
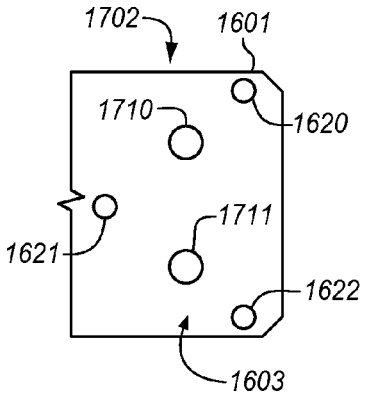

FIGS. 17A-17B illustrate top and bottom views of ink port adapter 1600 in an exemplary embodiment. The top view 1701 in FIG. 17A illustrates hose fitting 1610 and connecting holes 1620-1622 on top surface 1602 of ink port adapter 1600. The bottom view 1702 in FIG. 17B illustrates two openings 1710-1711 on bottom surface 1603 of ink port adapter 1600, and connecting holes 1620-1622. As is evident from top view 1701 and bottom view 1702, connecting holes 1620-1622 pass through the body 1601 of ink port adapter 1600 from top surface 1602 to bottom surface 1603. Openings 1710-1711 are configured to align with the two ink ports 1510-1511 of inkjet head 1500 (see FIG. 15). Although not visible in FIGS. 17A-17B, an ink path passes through body 1601 that connects hose fitting 1610 to openings 1710-1711.

Figure 18:
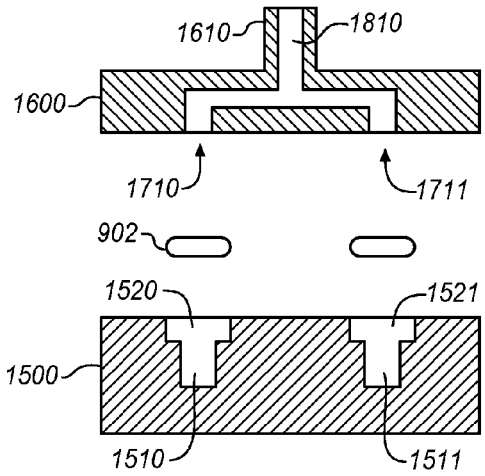
FIG. 18 is a cross-sectional view of an ink port adapter being attached to an inkjet head in an exemplary embodiment.

FIG. 18 is a cross-sectional view of ink port adapter 1600 being attached to inkjet head 1500 in an exemplary embodiment. FIG. 18 is a cross-section substantially along line 18-18 of FIG. 15. Ink ports 1510-1511 of inkjet head 1500 include recesses 1520-1521, respectively. O-rings 902 may be inserted into recesses 1520-1521. When compressed, o-rings 902 provide a seal between ink port adapter 1600 and inkjet head 1500. Openings 1710-1711 on ink port adapter 1600 align with ink ports 1510-1511 to provide a fluid connection. An ink path 1810 connects hose fitting 1610 to openings 1710-1711. Therefore, ink flowing from a hose into hose fitting 1610 will travel through adapter 1600 to both opening 1710 and opening 1711.

When in use, ink port adapter 1500 is placed onto end 1502 of inkjet head 1500, and is fastened to inkjet head 1500 with fastening members 1630. In FIG. 15, the other end (not shown) of inkjet head 1500 will have a similar configuration with ink ports, and an ink port adapter may be attached to the other end of inkjet head 1500 in a similar manner. A hose is connected to hose fitting 1610. The hose may be attached to an ink reservoir of a single color to supply one color of ink to inkjet head 1500. When one color of ink is supplied through the hose connected to hose fitting 1610, the ink will flow through hose fitting 1610, through ink path 1810, and out openings 1710-1711 into ink ports 1510-1511 of inkjet head 1500. Thus, even though inkjet head 1500 has two ink ports on each end for receiving two colors of ink, ink port adapter 1600 allows inkjet head 1500 to operate while receiving only one color of ink.

One type of inkjet head is referred to as a flow-through inkjet head. In a traditional inkjet head that is not a flow-through type, the ink channels typically include a restrictor, a chamber, and a nozzle. The ink enters the chamber through the restrictor, and is contained in the chamber until it is ejected out of the nozzle. A flow-through inkjet head has a structure with a return path out of the ink chamber. For example, an ink channel of a flow-through inkjet head may include another restrictor connected to the chamber that allows ink, which is not ejected out of the nozzle, to flow out of the chamber. Thus, ink may circulate or flow through the ink channels.

Figure 19:
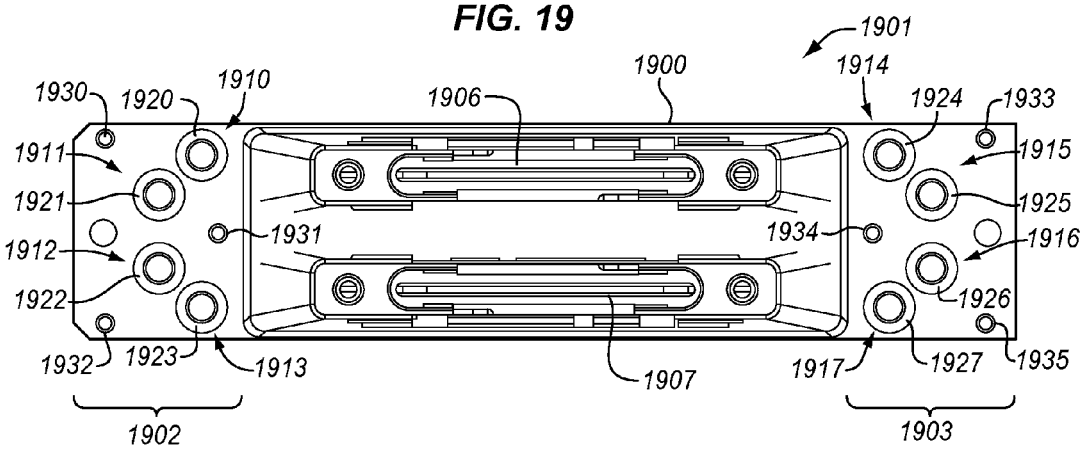
FIG. 19 illustrates an I/O side of an inkjet head in an exemplary embodiment.

FIG. 19 illustrates the I/O side 1901 of an inkjet head 1900 in an exemplary embodiment. Inkjet head 1900 is a flow-through head in this embodiment. I/O side 1901 has two ends 1902-1903 that are separated by electrical connectors 1906-1907. End 1902 includes four ink ports 1910-1913, and end 1903 includes four ink ports 1914-1917. To provide the flow-through characteristics, inkjet head 1900 has inlet ink ports and outlet ink ports on each end 1902-1903. For example, end 1902 includes inlet ink ports 1910 and 1913, and outlet ink ports 1911-1912. End 1909 includes inlet ink ports 1914 and 1917, and outlet ink ports 1915-1916. An inlet ink port comprises a port that allows ink or another print fluid to flow into inkjet head 1900. An outlet ink port comprises a port that allows ink or another print fluid to flow out of inkjet head 1900. Although not visible in FIG. 19, inlet ink ports 1910, 1913, 1914, and 1917 connect to supply manifolds within inkjet head 1900, and outlet ink ports 1911-1912 and 1915-1916 connect to return manifolds within inkjet head 1900.

In this embodiment, ink ports 1910-1917 may each include a recess 1920-1927, respectively, for receiving an o-ring, which is described further below. End 1902 also includes threaded holes 1930-1932 for receiving a fastening member, such as a screw or bolt, and end 1903 includes threaded holes 1933-1935.

Figure 20:
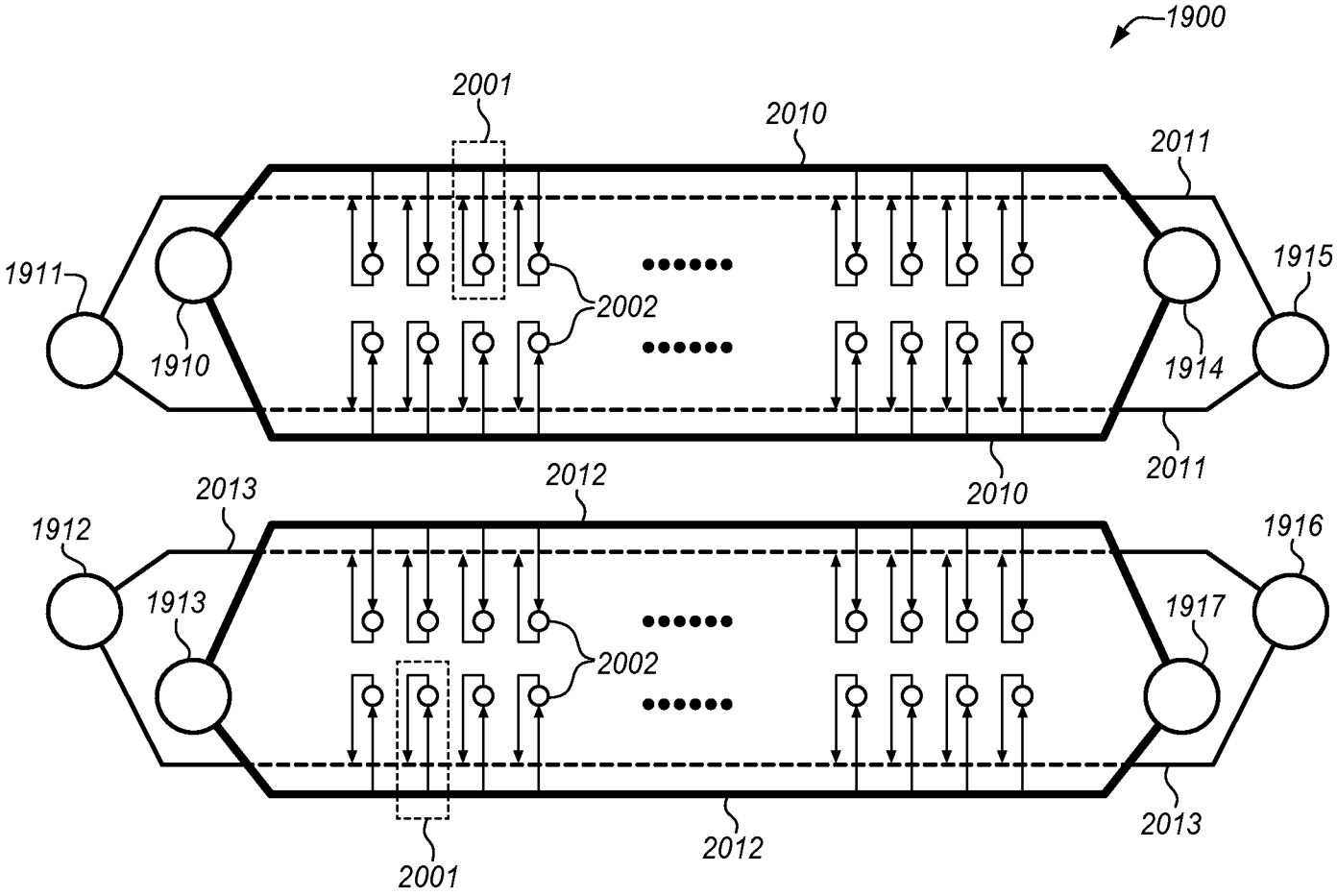
FIG. 20 is a schematic view of an inkjet head as shown in FIG. 19 in an exemplary embodiment.

FIG. 20 is a schematic view of inkjet head 1900 as shown in FIG. 19 in an exemplary embodiment. Inkjet head 1900 includes a plurality of ink channels 2001 that are aligned into rows. In this embodiment, there are four rows of ink channels 2001, each having a nozzle 2002, a chamber (not visible), and a mechanism (not visible) for ejecting a print fluid from the chamber and through the nozzle 2002. The top two rows of ink channels 2001 in FIG. 20 may be for a first color and the bottom two rows of ink channels 2001 may be for a second color, although inkjet head 1900 may be used for a single color. In this embodiment, inkjet head 1900 includes supply manifolds and return manifolds. For example, inkjet head 1900 includes supply manifold 2010 and a return manifold 2011 for the top two rows of ink channels 2001. Supply manifold 2010 acts to supply ink from a supply reservoir to a subset (i.e., one or more rows) of ink channels 2001 of inkjet head 1900, such as for a first color. Depending on the structure of ink channels 2001 within inkjet head 1900, the ink will flow from supply manifold 2010, through first restrictors, and into the chambers. Because of the flow-through nature of inkjet head 1900, ink (which is not ejected out of nozzles 2002 of ink channels 2001) will flow from the chambers, through a second restrictor, and into return manifold 2011. Return manifold 2011 acts to return ink from the subset of ink channels 2001 to a return reservoir, such as for the first color. Supply manifold 2010 is therefore fluidly connected to return manifold 2011 through ink channels 2001 of inkjet head 1900.

Inlet ink ports 1910 and 1914 provide pathways to supply manifold 2010. Thus, an ink reservoir may be connected in some manner to inlet ink ports 1910 and 1914 to deliver ink to supply manifold 2010. Because supply manifold 2010 includes inlets (i.e., inlet ink ports 1910 and 1914) at both ends 1902-1903 of inkjet head 1900 (see FIG. 19), ink is able to flow to all ink channels 2001 within inkjet head 1900 without dead space. Outlet ink ports 1911 and 1915 provide pathways to return manifold 2011. Thus, a return reservoir for the first color may be connected in some manner to outlet ink ports 1911 and 1915 to receive ink from return manifold 2011.

Inkjet head 1900 also includes supply manifold 2012 and a return manifold 2013 for the bottom two rows of ink channels 2001. Supply manifold 2012 acts to supply ink from a supply reservoir to another subset of ink channels 2001 of inkjet head 1900, such as for a second color. Depending on the structure of ink channels 2001 within inkjet head 1900, the ink will flow from supply manifold 2012, through first restrictors, and into the chambers. Because of the flow-through nature of inkjet head 1900, ink (which is not ejected out of nozzles 2002 of ink channels 2001) will flow from the chambers, through a second restrictor, and into return manifold 2013. Return manifold 2013 acts to return ink from the other subset of ink channels 2001 to a return reservoir, such as for the second color. Supply manifold 2012 is therefore fluidly connected to return manifold 2013 through ink channels 2001 of inkjet head 1900.

Inlet ink ports 1913 and 1917 provide pathways to supply manifold 2012. Thus, an ink reservoir may be connected in some manner to inlet ink ports 1913 and 1917 to deliver ink to supply manifold 2012. Because supply manifold 2012 includes inlets (i.e., inlet ink ports 1913 and 1917) at both ends 1902-1903 of inkjet head 1900 (see FIG. 19), ink is provided to flow to all ink channels 2001 within inkjet head 1900 without dead space. Outlet ink ports 1912 and 1916 provide pathways to return manifold 2013. Thus, a return reservoir may be connected in some manner to outlet ink ports 1912 and 1916 to receive ink from return manifold 2013.

Figure 21:
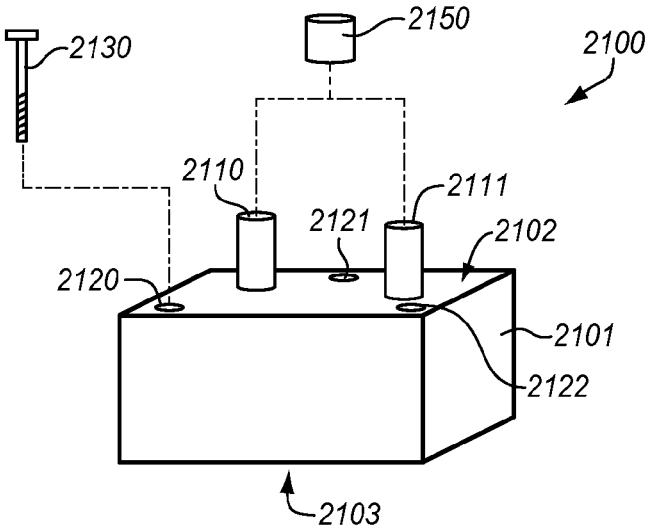
FIG. 21 is an isometric view of an ink port adapter in an exemplary embodiment.

If inkjet head 1900 is a two-color inkjet head, it may be used as a single-color inkjet head with the use of ink port adapters as described herein. FIG. 21 is an isometric view of an ink port adapter 2100 in an exemplary embodiment. Ink port adapter 2100 is an apparatus that may convert a two-color inkjet head to a single-color inkjet head, when the two-color inkjet head is a flow-through type. Ink port adapter 2100 includes a body 2101 having a top surface 2102 and a bottom surface 2103. Although the terms "top" and "bottom" are used herein, it is merely to distinguish the surfaces 2102-2103 in FIG. 21. The body 2101 of ink port adapter 2100 may be made from plastic, Teflon®, or any other desired material. Top surface 2102 includes a supply hose fitting 2110 and a return hose fitting 2111, which are each hollow cylindrical features that extend from top surface 2102 to act as a connection point for a hose or gasket. Although not shown in FIG. 21, hose fittings 2110-2111 may be barbed or have other surface features for securing a hose or otherwise interfacing with a hose or gasket. Ink port adapter 2100 also includes a plurality of connecting holes 2120-2122 that pass from top surface 2102 to bottom surface 2103 to align with threaded holes 1930-1932 or 1933-1935 on inkjet head 1900. Fastening members 2130, such as screws or bolts, are inserted through connecting holes 2120-2122, and screw into threaded holes 1930-1932 or 1933-1935 to secure ink port adapter 2100 to either end 1902-1903 of inkjet head 1900. Ink port adapter 2100 also includes a cap 2150 that is configured to cover supply hose fitting 2110 or return hose fitting 2111 to stop an ink flow as desired. The use of cap 2150 is discussed in further detail below.

Figure 22A:
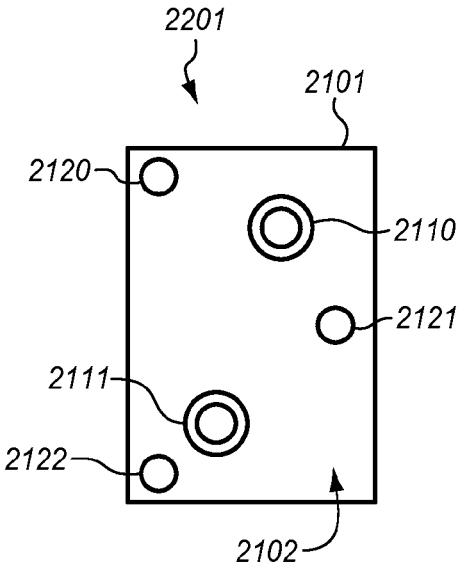
FIGS. 22A-22B illustrate top and bottom views of an ink port adapter in an exemplary embodiment.
Figure 22B:
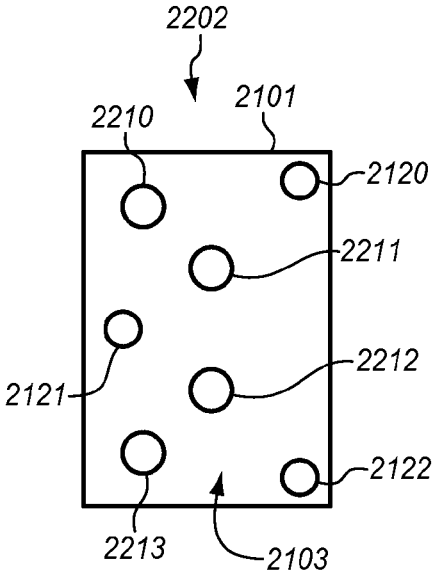

FIGS. 22A-22B illustrate top and bottom views of ink port adapter 2100 in an exemplary embodiment. The top view 2201 in FIG. 22A illustrates supply hose fitting 2110, return hose fitting 2111, and connecting holes 2120-2122 on top surface 2102 of ink port adapter 2100. The bottom view 2202 in FIG. 22B illustrates two supply openings 2210 and 2213 on bottom surface 2103 of ink port adapter 2100, two return openings 2211-2212 on bottom surface 2103 of ink port adapter 2100, and connecting holes 2120-2122. As is evident from top view 2201 and bottom view 2202, connecting holes 2120-2122 pass through the body 2101 of ink port adapter 2100 from top surface 2102 to bottom surface 2103. Supply openings 2210 and 2213 are configured to align with inlet ink ports (e.g., inlet ink ports 1910 and 1913) of inkjet head 1900 (see FIG. 19). Return openings 2211-2212 are configured to align with outlet ink ports (e.g., outlet ink ports 1911-1912) of inkjet head 1900 (see FIG. 19). Although not visible in FIGS. 22A-22B, an ink path passes through body 2101 that connects supply hose fitting 2110 to supply openings 2210 and 2213. Another separate ink path passes through body 2101 that connects return hose fitting 2111 to return openings 2211-2212. An ink path is a hollow channel through body 2101 that allows ink to flow. The placement of supply openings 2210 and 2213 and return openings 2211-2212 in FIG. 22B is just an example, and may change based on the placement of inlet ink ports and outlet ink ports on an inkjet head.

Figure 23:
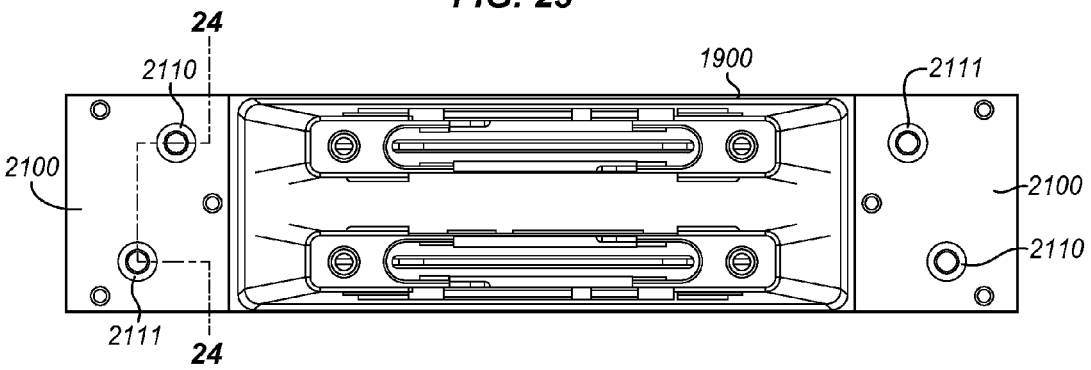
FIG. 23 illustrates ink port adapters installed on each end of an inkjet head in an exemplary embodiment.
Figure 24:
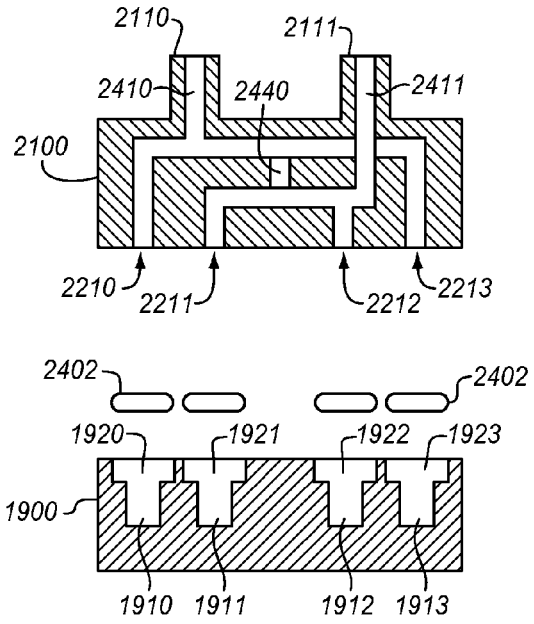
FIG. 24 is a cross-sectional view of an ink port adapter attached to an inkjet head in an exemplary embodiment.

FIG. 23 illustrates ink port adapters 2100 installed on each end of inkjet head 1900 in an exemplary embodiment. FIG. 24 is a cross-sectional view of ink port adapter 2100 attached to inkjet head 1900 in an exemplary embodiment. FIG. 24 is a cross-section approximately along line 24-24 of FIG. 23. Inlet ink ports 1910 and 1913 of inkjet head 1900 include recesses 1920 and 1923, respectively, and outlet ink ports 1911-1912 of inkjet head 1900 include recesses 1921-1922, respectively. O-rings 2402 may be inserted into recesses 1920-1923. When compressed, o-rings 2402 provide a seal between ink port adapter 2100 and inkjet head 1900. Supply openings 2210 and 2213 on ink port adapter 2100 align with inlet ink ports 1910 and 1913 to provide a fluid connection. An ink path 2410 connects supply hose fitting 2110 to supply openings 2210 and 2213, and represents a supply path in ink port adapter 2100. Therefore, ink flowing into supply hose fitting 2110 will travel through ink path 2410 to both supply openings 2210 and 2213 to supply ink to inkjet head 1900. Another ink path 2411 connects return hose fitting 2111 to return openings 2211-2212, and represents a return path in ink port adapter 2100. Therefore, ink flowing out of inkjet head 1900 and into return openings 2211-2212 will travel through ink path 2411 and out of return hose fitting 2111.

Ink port adapter 2100 further includes a bypass path 2440 between ink path 2410 and ink path 2411. Ink paths 2410 and 2411 are distinct ink paths through body 2101 except for the fluid connection via bypass path 2440. Bypass path 2440 is a high-impedance passage, which means that the fluid resistance of bypass path 2440 is greater than the fluid resistance of ink channels 2001 within inkjet head 1900. The length or width of bypass path 2440 may be designed in a desired manner to ensure that the fluid resistance of bypass path 2440 is greater than the fluid resistance of ink channels 2001. Bypass path 2440 helps reduce the pressure delta required for inkjet head 1900. If a bypass path were to have low impedance, a high capacity pump would be required. Bypass path 2440 also helps reduce difference in pressure between nozzles 2002 closer to an inlet ink port and nozzles 2002 closer to an outlet ink port.

Figure 25:
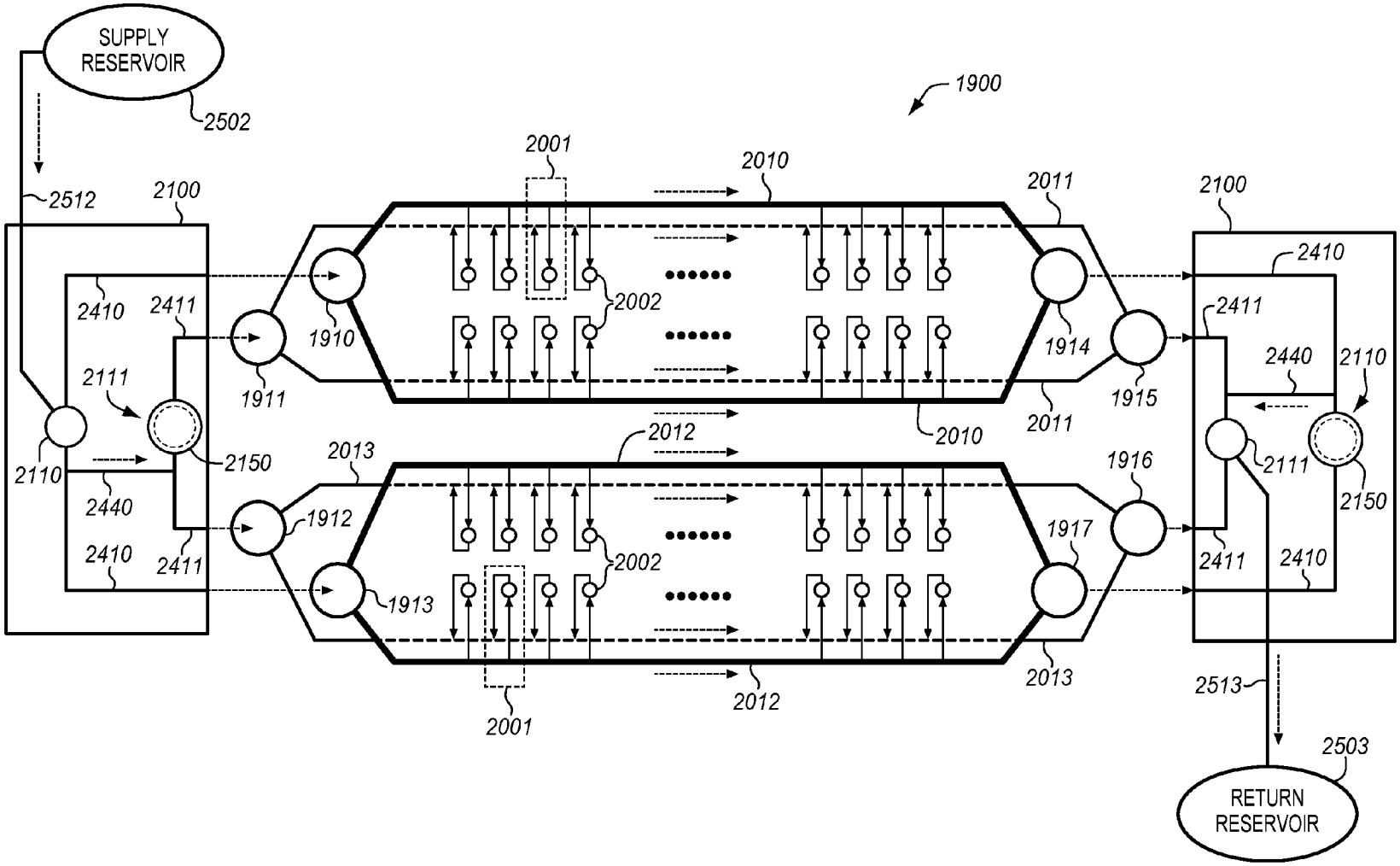
FIG. 25 is a schematic view of an inkjet head with ink port adapters attached in an exemplary embodiment.

FIG. 25 is a schematic view of inkjet head 1900 with ink port adapters 2100 attached in an exemplary embodiment. As in FIG. 23, an ink port adapter 2100 is attached to each end of inkjet head 1900. When an ink port adapter 2100 is attached to the left side of inkjet head 1900 in FIG. 25, supply hose fitting 2110 is fluidly connected to inlet ink ports 1910 and 1913 through ink path 2410. Return hose fitting 2111 is fluidly connected to outlet ink ports 1911-1912 through ink path 2411. Ink path 2410 is fluidly connected to ink path 2411 through high-impedance bypass path 2440.

When an ink port adapter 2100 is attached to the right side of inkjet head 1900 in FIG. 25, supply hose fitting 2110 is fluidly connected to inlet ink ports 1914 and 1917 through ink path 2410. Return hose fitting 2111 is fluidly connected to outlet ink ports 1915-1916 through ink path 2411. Ink path 2410 is fluidly connected to ink path 2411 through high-impedance bypass path 2440.

To operate the two-color inkjet head 1900 as a single color inkjet head, supply hose fitting 2110 on one end (i.e., the left-hand end) of inkjet head 1900 is connected to a supply reservoir 2502, such as by a hose 2512, a gasket, etc. At the same time, return hose fitting 2111 on this same end is covered with cap 2150 so that ink cannot flow into or out of return hose fitting 2111. On the other end (i.e., the right-hand end) of inkjet head 1900, return hose fitting 2111 is connected to a return reservoir 2503, such as by a hose 2513, a gasket, etc. At the same time, supply hose fitting 2110 on this same end is covered with cap 2150 so that ink cannot flow into or out of supply hose fitting 2110. When ink port adapters 2100 are connected in the manner schematically shown in FIG. 25, one end (i.e., the left-hand end) of inkjet head 1900 acts as the inlet end for a single color of ink, while the other end (i.e., the right-hand end) of inkjet head 1900 acts as the outlet end for the single color of ink. A pressure differential is created between supply reservoir 2502 and return reservoir 2503 so that ink flows through inkjet head 1900 as illustrated by the arrows.

Figure 26:
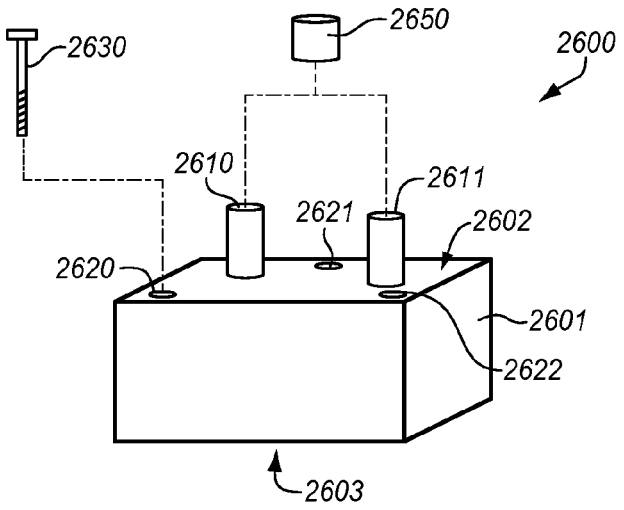
FIG. 26 is an isometric view of an ink port adapter in an exemplary embodiment.

FIG. 26 is an isometric view of an ink port adapter 2600 in an exemplary embodiment. Ink port adapter 2600 is similar to ink port adapter 2100, butdoes not include a bypass path as does ink port adapter 2100. Ink port adapter 2600 includes a body 2601 having a top surface 2602 and a bottom surface 2603. Although the terms "top" and "bottom" are used herein, it is merely to distinguish the surfaces 2602-2603 in FIG. 26. Top surface 2602 includes a supply hose fitting 2610 and a return hose fitting 2611, which are each hollow cylindrical features that extend from top surface 2602 to act as a connection point for a hose or gasket. Although not shown in FIG. 26, hose fittings 2610-2611 may be barbed or have other surface features for securing a hose or otherwise interfacing with a hose or gasket. Ink port adapter 2600 also includes a plurality of connecting holes 2620-2622 that pass from top surface 2602 to bottom surface 2603 to align with threaded holes 1930-1932 or 1933-1935 on inkjet head 1900. Fastening members 2630, such as screws or bolts, are inserted through connecting holes 2620-

2622, and screw into threaded holes 1930-1932 or 1933-1935 to secure ink port adapter 2600 to either end 1902-1903 of inkjet head 1900. Ink port adapter 2600 also includes one or more caps 2650 that are configured to cover supply hose fitting 2610 or return hose fitting 2611 to stop an ink flow as desired. The use of cap 2650 is discussed in further detail below.

Figure 27A:
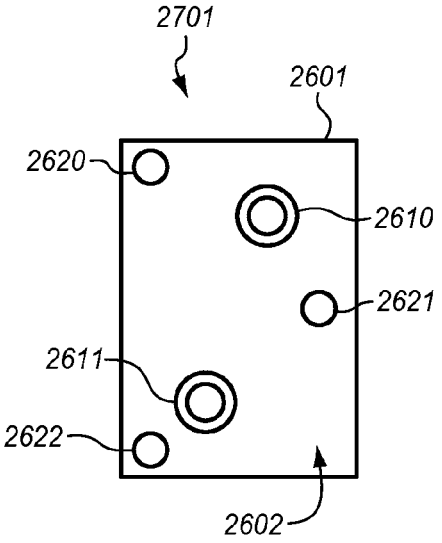
FIGS. 27A-27B illustrate top and bottom views of an ink port adapter in an exemplary embodiment.
Figure 27B:
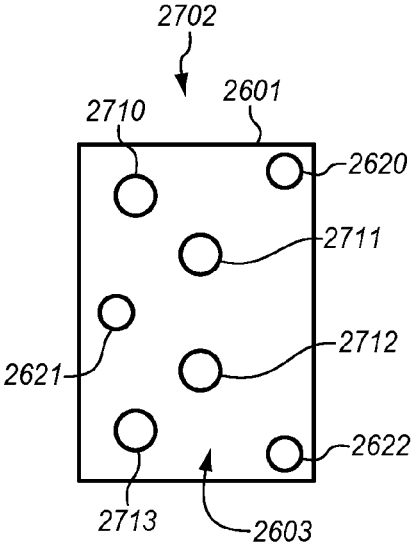

FIGS. 27A-27B illustrate top and bottom views of ink port adapter 2600 in an exemplary embodiment. The top view 2701 in FIG. 27A illustrates supply hose fitting 2610, return hose fitting 2611, and connecting holes 2620-2622 on top surface 2602 of ink port adapter 2600. The bottom view 2702 in FIG. 27B illustrates two supply openings 2710 and 2713 on bottom surface 2603 of ink port adapter 2600, two return openings 2711-2712 on bottom surface 2603 of ink port adapter 2600, and connecting holes 2620-2622. As is evident from top view 2701 and bottom view 2702, connecting holes 2620-2622 pass through the body 2601 of ink port adapter 2600 from top surface 2602 to bottom surface 2603. Supply openings 2710 and 2713 are configured to align with inlet ink ports (e.g., inlet ink ports 1910 and 1913) of inkjet head 1900 (see FIG. 19). Return openings 2711-2712 are configured to align with outlet ink ports (e.g., outlet ink ports 1911-1912) of inkjet head 1900 (see FIG. 19). Although not visible in FIGS. 27A-27B, an ink path passes through body 2601 that connects supply hose fitting 2610 to supply openings 2710 and 2713. Another separate ink path passes through body 2601 that connects return hose fitting 2611 to return openings 2711-2712. The placement of supply openings 2710 and 2713 and return openings 2711-2712 in FIG. 27B is just an example, and may change based on the placement of inlet ink ports and outlet ink ports on an inkjet head.

Figure 28:
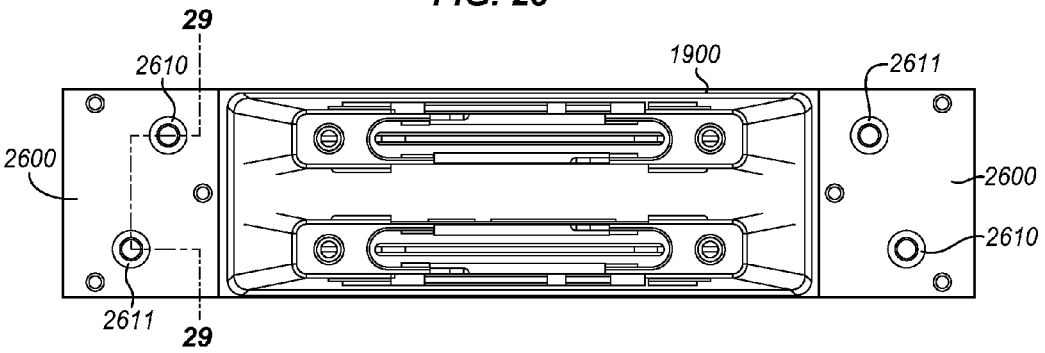
FIG. 28 illustrates ink port adapters installed on each end of an inkjet head in an exemplary embodiment.
Figure 29:
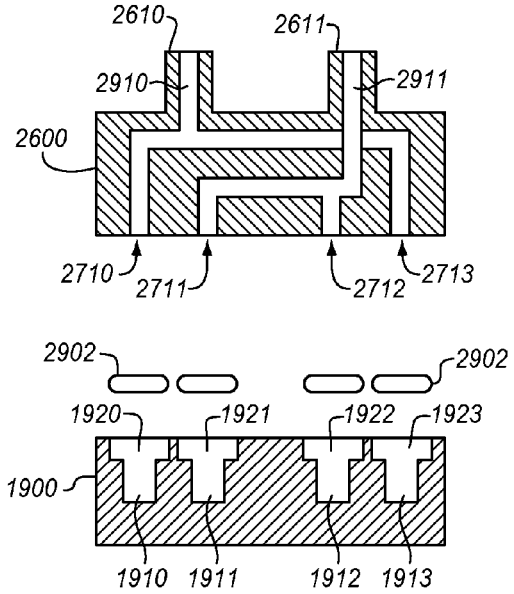
FIG. 29 is a cross-sectional view of an ink port adapter attached to an inkjet head in an exemplary embodiment.

FIG. 28 illustrates ink port adapters 2600 installed on each end of inkjet head 1900 in an exemplary embodiment. FIG. 29 is a cross-sectional view of ink port adapter 2600 attached to inkjet head 1900 in an exemplary embodiment. FIG. 29 is a cross-section approximately along line 29-29 of FIG. 28. Inlet ink ports 1910 and 1913 of inkjet head 1900 include recesses 1920 and 1923, respectively, and outlet ink ports 1911-1912 of inkjet head 1900 include recesses 1921-1922, respectively. O-rings 2902 may be inserted into recesses 1920-1923. When compressed, o-rings 2902 provide a seal between ink port adapter 2600 and inkjet head 1900. Supply openings 2710 and 2713 on ink port adapter 2600 align with inlet ink ports 1910 and 1913 to provide a fluid connection. An ink path 2910 connects supply hose fitting 2610 to supply openings 2710 and 2713, and represents a supply path in ink port adapter 2600. Therefore, ink flowing into supply hose fitting 2610 will travel through ink path 2910 to both supply openings 2710 and 2713 to supply ink to inkjet head 1900. Another ink path 2911 connects return hose fitting 2611 to return openings 2711-2712, and represents a return path in ink port adapter 2600. Therefore, ink flowing out of inkjet head 1900 and into return openings 2711-2712 will travel through ink path 2911 and out of return hose fitting 2611. Ink port adapter 2600 does not include a bypass path between ink path 2910 and ink path 2911 as in the prior embodiment. Thus, ink paths 2910 and 2911 are distinct ink paths through body 2601.

Figure 30:
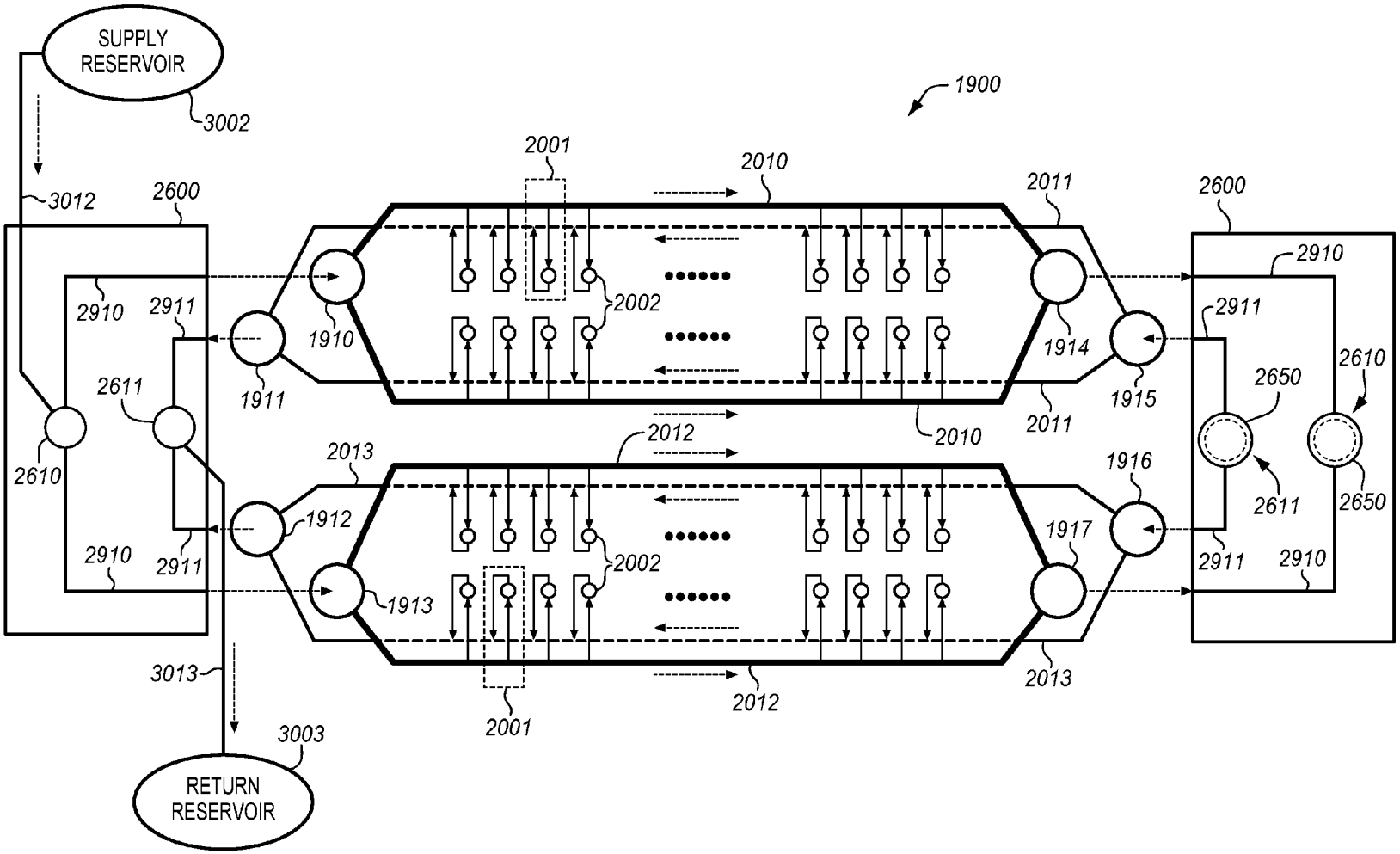
FIG. 30 is a schematic view of an inkjet head with ink port adapters attached in an exemplary embodiment.

FIG. 30 is a schematic view of inkjet head 1900 with ink port adapters 2600 attached in an exemplary embodiment. As in FIG. 28, an ink port adapter 2600 is attached to each end of inkjet head 1900. When an ink port adapter 2600 is attached to the left side of inkjet head 1900 in FIG. 30, supply hose fitting 2610 is fluidly connected to inlet ink ports 1910 and 1913 through ink path 2910. Return hose fitting 2611 is fluidly connected to outlet ink ports 1911-1912 through ink path 2911.

When an ink port adapter 2600 is attached to the right side of inkjet head 1900 in FIG. 30, supply hose fitting 2610 is fluidly connected to inlet ink ports 1914 and 1917 through ink path 2910. Return hose fitting 2611 is fluidly connected to outlet ink ports 1915-1916 through ink path 2911.

To operate the two-color inkjet head 1900 as a single color inkjet head, supply hose fitting 2610 on one end (i.e., the left-hand end) of inkjet head 1900 is connected to a supply reservoir 3002, such as by a hose 3012, a gasket, etc. Return hose fitting 2611 on this same end is connected to a return reservoir 2503, such as by a hose 2513, a gasket, etc. On the other end (i.e., the right-hand end) of inkjet head 1900, return hose fitting 2611 and supply hose fitting 2610 are both covered with cap 2650. When ink port adapters 2600 are connected in the manner schematically shown in FIG. 30, one end (i.e., the left-hand end) of inkjet head 1900 acts as the inlet end and the outlet for a single color of ink. A pressure differential is created between supply reservoir 3002 and return reservoir 3003 so that ink flows through inkjet head 1900 as illustrated by the arrows.

Figure 31:
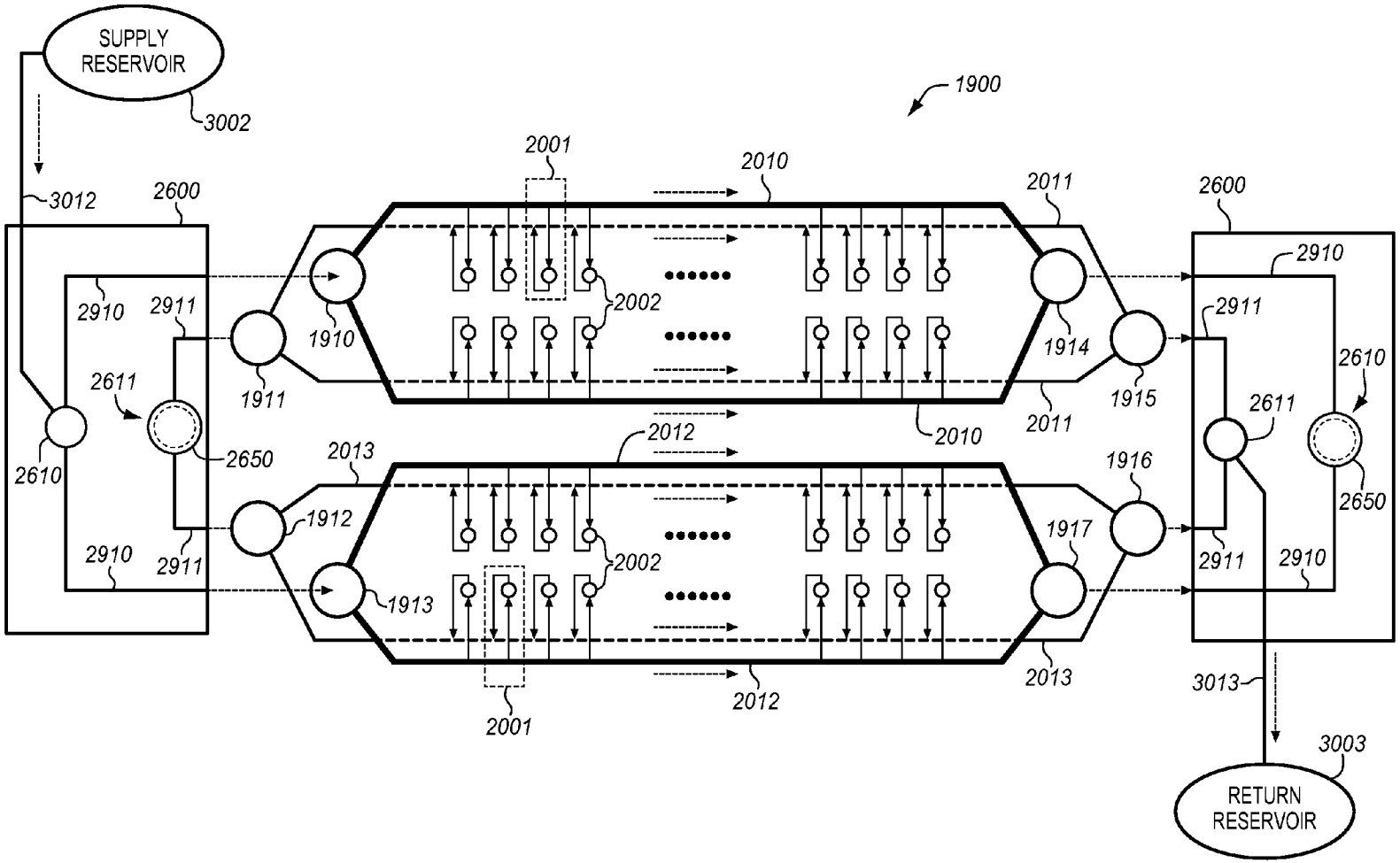
FIG. 31 is a schematic view of an inkjet head with ink port adapters attached in an exemplary embodiment.

FIG. 31 is a schematic view of inkjet head 1900 with ink port adapters 2600 attached in an exemplary embodiment. As in FIG. 28, an ink port adapter 2600 is attached to each end of inkjet head 1900. When an ink port adapter 2600 is attached to the left side of inkjet head 1900 in FIG. 31, supply hose fitting 2610 is fluidly connected to inlet ink ports 1910 and 1913 through ink path 2910. Return hose fitting 2611 is fluidly connected to outlet ink ports 1911-1912 through ink path 2911.

When an ink port adapter 2600 is attached to the right side of inkjet head 1900 in FIG. 31, supply hose fitting 2610 is fluidly connected to inlet ink ports 1914 and 1917 through ink path 2910. Return hose fitting 2611 is fluidly connected to outlet ink ports 1915-1916 through ink path 2911.

To operate the two-color inkjet head 1900 as a single color inkjet head, supply hose fitting 2610 on one end (i.e., the left-hand end) of inkjet head 1900 is connected to a supply reservoir 3002, such as by a hose 3012, a gasket, etc. At the same time, return hose fitting 2611 on this same end is covered with cap 2650 so that ink cannot flow into or out of return hose fitting 2611. On the other end (i.e., the right-hand end) of inkjet head 1900, return hose fitting 2611 is connected to a return reservoir 3003, such as by a hose 3013, a gasket, etc. At the same time, supply hose fitting 2610 on this same end is covered with cap 2650 so that ink cannot flow into or out of supply hose fitting 2610. When ink port adapters 2600 are connected in the manner schematically shown in FIG. 31, one end (i.e., the left-hand end) of inkjet head 1900 acts as the inlet end for a single color of ink, while the other end (i.e., the right-hand end) of inkjet head 1900 acts as the outlet end for the single color of ink. A pressure differential is created between supply reservoir 3002 and return reservoir 3003 so that ink flows through inkjet head 1900 as illustrated by the arrows.

The ink port adapters described above are able to transform multi-color inkjet heads for use with fewer colors. For example, if an ink port adapter is attached to a four-color inkjet head, then the four-color inkjet head may be used as a two-color or single-color inkjet head. If an ink port adapter is attached to a two-color inkjet head, then the two-color inkjet head may be used as a single-color inkjet head. Therefore, a consumer may not have to buy new inkjet heads for different applications. A consumer may buy a four-color head, and use that four-color head for four-color printing in one application, two-color printing in another application (with an adapter), or single-color printing in yet another application (with an adapter). Use of the ink port adapters described above advantageously gives the consumer flexibility in printing with an individual inkjet head. The ink port adapter described above are able to reduce the number of hoses or other connecting lines that are needed to supply ink to, or draw ink from, an inkjet head, which makes installation less cumbersome.

Although specific embodiments were described herein, the scope of the invention is not limited to those specific embodiments. The scope of the invention is defined by the following claims and any equivalents thereof.

I claim:

1. An apparatus comprising:

an ink port adapter of an inkjet head, the ink port adapter comprising:

a body having a first surface and a second surface;

a supply hose fitting that extends from the first surface of the body;

a return hose fitting that extends from the first surface of the body;

two supply openings on the second surface of the body;

two return openings on the second surface of the body;

a first ink path through the body that connects the supply hose fitting to the supply openings;

a second ink path through the body that connects the return hose fitting to the return openings; and a bypass path that connects between the first ink path and the second ink path.

2. The apparatus of claim 1 wherein:

the inkjet head includes a plurality of flow-through ink channels; and the bypass path has a higher fluid resistance than the flow-through ink channels of the inkjet head.

3. The apparatus of claim 1 wherein the ink port adapter further includes:

a cap configured to cover the supply hose fitting or the return hose fitting.

4. The apparatus of claim 1 further comprising:

fastening members configured to attach the ink port adapter to the inkjet head.

5. The apparatus of claim 4 wherein:

the ink port adapter further includes a plurality of connecting holes through the body to align with threaded holes on one end of the inkjet head; and the fastening members are inserted through the connecting holes of the ink port adapter to screw into the threaded holes on the one end of the inkjet head.

6. The apparatus of claim 1 wherein:

the supply hose fitting is configured to connect with a supply reservoir ; and the return hose fitting is configured to connect with a return reservoir.

7. An apparatus comprising:

an inkjet head having flow-through ink channels, wherein each end of the inkjet head includes two inlet ink ports and two outlet ink ports; and a first ink port adapter and a second ink port adapter;

wherein each of the first ink port adapter and the second ink port adapter comprises:

a body having a first surface and a second surface;

a supply hose fitting that extends from the first surface of the body;

a return hose fitting that extends from the first surface of the body;

two supply openings on the second surface of the body that align with the two inlet ink ports on one end of the inkjet head;

two return openings on the second surface of the body that align with the two outlet ink ports on the one end of the inkjet head;

a first ink path through the body that connects the supply hose fitting to the supply openings;

a second ink path through the body that connects the return hose fitting to the return openings; and a bypass path that connects between the first ink path and the second ink path;

wherein the first ink port adapter is attached to a first end of the inkjet head;

wherein the second ink port adapter is attached to a second end of the inkjet head.

8. The apparatus of claim 7 wherein:

a first cap is attached to the return hose fitting on the first ink port adapter; and a second cap is attached to the supply hose fitting on the second ink port adapter.

9. The apparatus of claim 8 wherein:

a first hose is attached to the supply hose fitting on the first ink port adapter, and is attached to a supply reservoir for a single color of ink; and a second hose is attached to the return hose fitting on the second ink port adapter, and is attached to a return reservoir for the single color of ink.

10. The apparatus of claim 9 wherein:

a pressure differential is created between the supply reservoir and the return reservoir.

11. The apparatus of claim 7 wherein:

the bypass path has a higher fluid resistance than the flow-through ink channels of the inkjet head.

12. The apparatus of claim 7 further comprising:

o-rings compressed between the supply openings and the return openings of the first ink port adapter, and the inlet ink ports and the outlet ink ports on the first end of the inkjet head;

wherein:

the o-rings are seated in recesses in the inlet ink ports and the outlet ink ports on the first end of the inkjet head.

13. The apparatus of claim 7 further comprising:

fastening members configured to attach the first ink port adapter to the first end of the inkjet head.

14. The apparatus of claim 13 wherein:

the first ink port adapter further includes a plurality of connecting holes through the body to align with threaded holes on the first end of the inkjet head; and the fastening members are inserted through the connecting holes of the first ink port adapter to screw into the threaded holes on the first end of the inkjet head.

15. An apparatus comprising:

an inkjet head having flow-through ink channels, wherein each end of the inkjet head includes two inlet ink ports and two outlet ink ports; and a first ink port adapter and a second ink port adapter;

wherein each of the first ink port adapter and the second ink port adapter comprises:

a body having a first surface and a second surface;

a supply hose fitting that extends from the first surface of the body;

a return hose fitting that extends from the first surface of the body;

two supply openings on the second surface of the body that align with the two inlet ink ports on one end of the inkjet head;

two return openings on the second surface of the body that align with the two outlet ink ports on the one end of the inkjet head;

a first ink path through the body that connects the supply hose fitting to the supply openings; and a second ink path through the body that connects the return hose fitting to the return openings;

wherein the first ink port adapter is attached to a first end of the inkjet head;

wherein the second ink port adapter is attached to a second end of the inkjet head.

16. The apparatus of claim 15 wherein:

a first cap is attached to the return hose fitting on the first ink port adapter; and a second cap is attached to the supply hose fitting on the second ink port adapter.

17. The apparatus of claim 16 wherein:

a first hose is attached to the supply hose fitting on the first ink port adapter, and is attached to a supply reservoir for a single color of ink; and a second hose is attached to the return hose fitting on the second ink port adapter, and is attached to a return reservoir for the single color of ink.

18. The apparatus of claim 15 wherein:

a first cap is attached to the return hose fitting on the second ink port adapter; and a second cap is attached to the supply hose fitting on the second ink port adapter.

19. The apparatus of claim 18 wherein:

a first hose is attached to the supply hose fitting on the first ink port adapter, and is attached to a supply reservoir for a single color of ink; and a second hose is attached to the return hose fitting on the first ink port adapter, and is attached to a return reservoir for the single color of ink.

20. The apparatus of claim 15 further comprising:

o-rings compressed between the supply openings and the return openings of the first ink port adapter, and the inlet ink ports and the outlet ink ports on the first end of the inkjet head;

wherein the o-rings are seated in recesses in the inlet ink ports and the outlet ink ports on the first end of the inkjet head.

* * * * *